US007944423B2

(12) United States Patent
Kurumisawa

(10) Patent No.: US 7,944,423 B2
(45) Date of Patent: May 17, 2011

(54) IMAGE PROCESSING UNIT WITH BLACK-AND-WHITE LINE SEGMENT PATTERN DETECTION, IMAGE PROCESSING METHOD, IMAGE DISPLAY DEVICE USING SUCH IMAGE PROCESSING UNIT, AND ELECTRONIC APPARATUS USING SUCH IMAGE DISPLAY DEVICE

(75) Inventor: Takashi Kurumisawa, Shiojiri (JP)

(73) Assignee: Sony Corporation, Tokyo (JP)

( * ) Notice: Subject to any disclaimer, the term of this patent is extended or adjusted under 35 U.S.C. 154(b) by 854 days.

(21) Appl. No.: 11/353,090

(22) Filed: Feb. 14, 2006

(65) Prior Publication Data

US 2006/0132660 A1 Jun. 22, 2006

(30) Foreign Application Priority Data

Mar. 24, 2005 (JP) ..... 2005-085564

(51) Int. Cl.
*G09G 3/36* (2006.01)

(52) U.S. Cl. ..... 345/88

(58) Field of Classification Search ..... 345/204, 345/87–111, 694–699; 315/169.1–169.3
See application file for complete search history.

(56) References Cited

U.S. PATENT DOCUMENTS 5,363,219 A * 11/1994 Yoshida ..... 358/539
5,621,826 A * 4/1997 Katayama et al. ..... 382/298
5,668,646 A * 9/1997 Katayama et al. ..... 358/530
6,243,070 B1 6/2001 Hill et al.
6,459,419 B1 * 10/2002 Matsubayashi ..... 345/156
6,714,206 B1 * 3/2004 Martin et al. ..... 345/589
2002/0122019 A1 * 9/2002 Baba et al. ..... 345/88
2003/0085906 A1 5/2003 Elliott et al.
2004/0051724 A1 3/2004 Elliott et al.
2004/0174389 A1 * 9/2004 Ben-David et al. ..... 345/694
2004/0234163 A1 * 11/2004 Lee et al. ..... 382/298

FOREIGN PATENT DOCUMENTS

EP 1 260 960 11/2002
JP 03-109525 5/1991
JP 10-010517 1/1998
JP 10-10517 1/1998

(Continued)

OTHER PUBLICATIONS

European Patent Application No. EP 05 25 8083.4—European Search Report dated Aug. 21, 2007.

*Primary Examiner* — Chanh Nguyen
*Assistant Examiner* — Long Pham
(74) *Attorney, Agent, or Firm* — K&L Gates LLP

(57) ABSTRACT

An image processing unit includes a discriminating unit for discriminating, for every data unit of an input image signal, whether the data unit is black-and-white image data or color image data; a black-and-white image processing unit for detecting at least one of pre-stored line segment patterns from the data unit, and generating color signals for a black-and-white image corresponding to the detected line segment pattern when the discriminating unit has discriminated that the data unit is black-and-white image data; and a color image processing unit for generating color signals for a color image when the discriminating unit has discriminated that the data unit is color image data or when the black-and-white image processing unit has failed to detect any of the pre-stored line segment patterns from the data unit.

17 Claims, 10 Drawing Sheets

FOREIGN PATENT DOCUMENTS

| | | |
|---|---|---|
| JP | 2004-78215 | 3/2004 |
| JP | 2004-219596 | 8/2004 |
| JP | 2004-0529396 | 9/2004 |
| JP | 2004-538523 | 12/2004 |
| JP | 2005-062833 | 3/2005 |
| WO | WO 02/101644 | 12/2002 |
| WO | WO 03/015066 | 2/2003 |
| WO | 03/088203 | 10/2003 |

* cited by examiner

Rout = (0.25R1 + 0.50R2 + 0.25R3
+ 0.50R4 + 1.00R5 + 0.50R6
+ 0.25R7 + 0.50R8 + 0.25R9)/4.00

Rout = (1.00R1 + 1.00R2 + 0.50R3
+ 1.00R4 + 1.00R5 + 0.50R6
+ 0.25R7 + 0.50R8 + 0.25R9)/6.25

0.5

Rout = (1.00R5 + 0.50R6 + 0.50R8
+ 0.25R9)/2.25

Rout = (1.00R4 + 1.00R5 + 0.50R6
+ 0.50R7 + 0.50R8 + 0.25R9)/3.75

Rout = (1.00R2 + 0.50R3
+ 1.00R5 + 0.50R6
+ 0.50R8 + 0.25R9)/3.75

IMAGE PROCESSING UNIT WITH BLACK-AND-WHITE LINE SEGMENT PATTERN DETECTION, IMAGE PROCESSING METHOD, IMAGE DISPLAY DEVICE USING SUCH IMAGE PROCESSING UNIT, AND ELECTRONIC APPARATUS USING SUCH IMAGE DISPLAY DEVICE

RELATED APPLICATIONS

The instant application claims priority from Japanese application JP 2005-85564 filed Mar. 24, 2005 which is incorporated herein by reference in its entirety. The instant application also relates to Japanese application JP 2004-195732 filed Jul. 1, 2004 which is incorporated herein by reference in its entirety.

BACKGROUND

The disclosure relates to image processing unit and method, as well as an image display device and an electronic apparatus using such image processing unit and method.

In particular, the disclosure relates to an electro-optical device such as a liquid crystal device and to an electronic apparatus. Further, the disclosure relates to an electrophoresis device such as an electronic paper and an electroluminescent (EL) device.

Recently, color image display devices such as a color liquid crystal display device have been used to a portable terminal device such as a mobile phone, a PDA, etc. For example, a liquid crystal display device performs color display such that color filters are provided on one of a pair of transparent substrates with liquid crystal interposed therebetween. A general color filter is configured by repeatedly arranging red (R), green (G), and blue (B) filter regions according to an additive color mixing system. In particular, the red filter regions, the green filter regions, and the blue color filter regions are formed to be adjacent to one another, and one red filter region, one green filter region, and one blue filter region form one color pixel.

In a case that a color image display device using RGB color filters performs color display, colors that can be represented by R, G, and B colors are limited to colors in a region defined by a color triangle whose vertices are R, G, and B on a CIE chromaticity diagram.

Meanwhile, a method that forms one color pixel with sub-pixels of four colors containing one more color in addition to R, G, and B is disclosed in JP-A-3-109525 which is incorporated herein by reference in its entirety. Further, a method of realizing color display and high-definition black-and-white display by using R, G, B, and white pixels is disclosed in JP-A-10-10517 which is incorporated herein by reference in its entirety.

SUMMARY

In accordance with an embodiment, an image display device comprises a display panel having a plurality of pixel regions, wherein each of the pixel regions has four color sub-pixels; an image processing unit for generating color signals for the four color sub-pixels from an input image signal; and a control unit for driving the display panel to display an image in the pixel regions of the display panel on the basis of the color signals. The image processing unit includes a discriminating unit for discriminating, for every data unit of the input image signal, whether the data unit is black-and-white image data or color image data; a black-and-white image processing unit for detecting at least one of pre-stored line segment patterns from the data unit, and generating color signals for a black-and-white image corresponding to the detected line segment pattern when the discriminating unit has discriminated that the data unit is black-and-white image data; and a color image processing unit for generating color signals for a color image when the discriminating unit has discriminated that the data unit is color image data or when the black-and-white image processing unit has failed to detect any of the pre-stored line segment patterns from the data unit.

In accordance with a further embodiment, an electronic apparatus comprises the image display device described immediately above.

In accordance with another embodiment, an image processing unit comprises a discriminating unit for discriminating, for every data unit of an input image signal, whether the data unit is black-and-white image data or color image data; a black-and-white image processing unit for detecting at least one of pre-stored line segment patterns from the data unit, and generating color signals for a black-and-white image corresponding to the detected line segment pattern when the discriminating unit has discriminated that the data unit is black-and-white image data; and a color image processing unit for generating color signals for a color image when the discriminating unit has discriminated that the data unit is color image data or when the black-and-white image processing unit has failed to detect any of the pre-stored line segment patterns from the data unit.

In accordance with yet another embodiment, an image processing method comprises discriminating, for every data unit of an input image signal, whether the data unit is black-and-white image data or color image data; detecting at least one of pre-stored line segment patterns from the data unit, and generating color signals for a black-and-white image corresponding to the detected line segment pattern when it has been discriminated that the data unit is black-and-white image data; and generating color signals for a color image when it has been discriminated that the data unit is color image data or when none of the pre-stored line segment patterns have been detected from the data unit.

The objects, features and advantages of the present invention will become apparent upon consideration of the following detailed description of the specific embodiments thereof, especially when taken in connection with the accompanying drawings.

BRIEF DESCRIPTION OF THE DRAWINGS

The embodiments of the invention will be described with reference to the accompanying drawings, wherein like numbers reference like elements.

DESCRIPTION OF EXEMPLARY EMBODIMENTS

Figure 1:
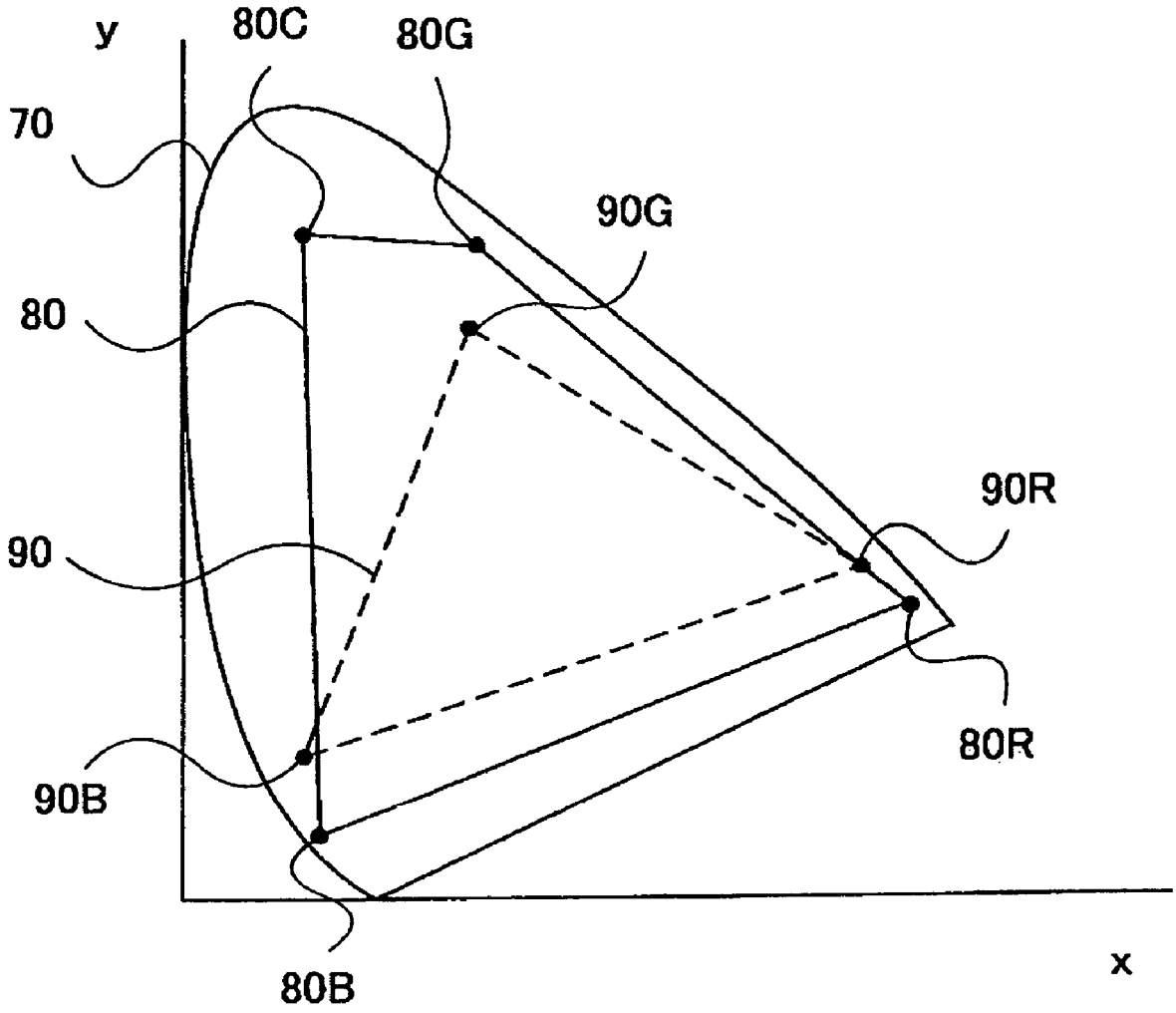
FIG. 1 is a chromaticity diagram showing the color reproduction range of a color filter according to an embodiment of the invention.

Before the embodiments of the invention are explained in detail, it is to be understood that the invention is not limited in its application to the details of construction and the arrangements of components set forth in the following description or illustrated in the drawing. The invention is capable of other embodiments and of being practiced or being carried out in various ways. Also, it is understood that the phraseology and terminology used herein are for the purpose of description and should not be regarded as limiting. The use of letters to identify steps of a method or process is simply for identification and is not meant to indicate that the steps should be performed in a particular order.

Hereinafter, embodiments according to the invention will be described with reference to the accompanying drawings. In the following description, a liquid crystal panel will be described as an example of an electro-optical panel according to the embodiments of the invention.

Color Filter

First, a color filter according to an embodiment of the invention will be described. In this embodiment, a four-color filter which has RGB regions used as a general color filter and additional color region is used. As additional color, cyan, white (achromatic color), yellow, and so on are conceivable but cyan (C) will be used in the following description.

FIG. 1 shows a color reproduction area of a color filter on a CIE chromaticity diagram. A visible color region 70 for a human being is horseshoe-shaped as shown in FIG. 1. A triangular color reproduction area 90 shown by a dashed line is the color reproduction area of a RGB color filter and apexes 90R, 90G, and 90B correspond to red, green, and blue display colors, respectively. In other words, when using a RGB color filter, colors in the color reproduction area 90 are reproducible.

Meanwhile, the color reproduction area 80 of a four-color filter using cyan in addition to RGB has a rectangular shape shown by a solid line. Apexes 80R, 80G, 80B, and 80C correspond to red, green, blue, and cyan, respectively. As can be seen by comparing the color reproduction area 90 of a three-color filter shown in FIG. 1 with the color reproduction area 80 of a four-color filter, the color reproduction area that the display device can display is enlarged by using a four-color filter having a cyan color filter in addition to RGB color filters and thus the display device can display various colors.

Black-and-White Image Display

Figure 2A:
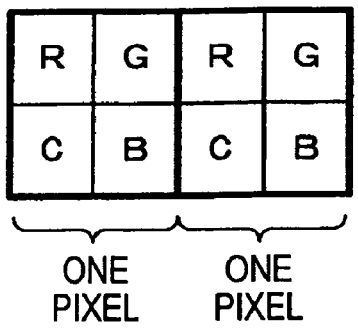
FIG. 2A is an example of the construction of the color filter.
Figure 2B:
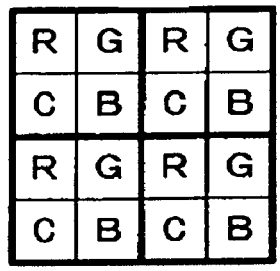
FIG. 2B is another example of the construction of the color filter.
Figure 2C:
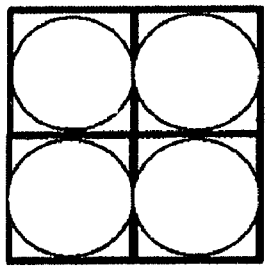
FIG. 2C is an example of black-and-white image display of the color filter.
Figure 2D:
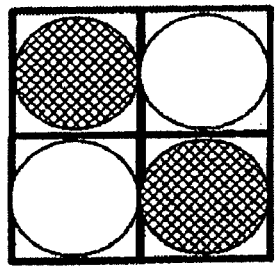
FIG. 2D is another example of the black-and-white image display of the color filter.

Next, the black-and-white image display of a display device using four-color filters will be described. FIGS. 2A to 2F show examples of the construction of a four-color filter. As shown in FIG. 2A, one pixel is composed of R, G, B, and C sub-pixels. Now, in a case of considering that four pixels are arranged in a two-by-two matrix as shown in FIG. 2B and every pixel has R, G, B, and C color data, black-and-white images capable of being represented by the four pixels becomes pixel units as shown in FIGS. 2C and 2D.

Figure 2E:
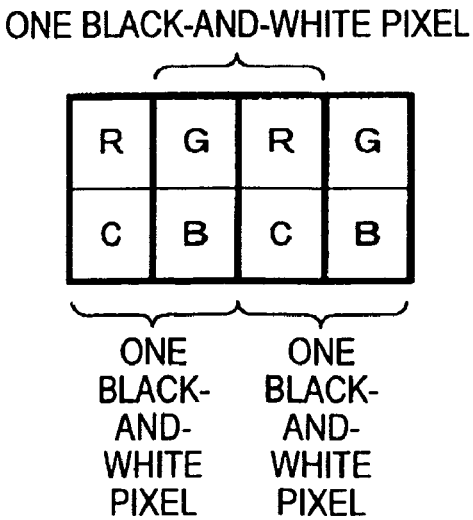
FIG. 2E is another example of the construction of the color filter.
Figure 2F:
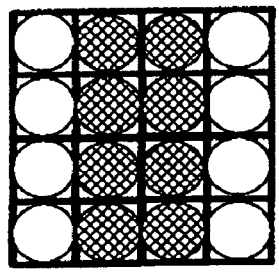
FIG. 2F is another example of the black-and-white image display of the color filter.

However, in a case of arrange two pixels in a horizontal direction, it is possible to form one pixel even by the combination of four sub-pixels in the middle, as shown in FIG. 2E. Therefore, when R, G, B, and C color data are prepared in each sub-pixel unit (that is, twice the number of the color pixels of the display panel in the horizontal direction and the vertical direction) and black or white is displayed by four sub-pixels in the middle of FIG. 2E, it is possible to improve the resolution into twice (twice in the horizontal direction in this example) as shown in FIG. 2F.

Figure 3:
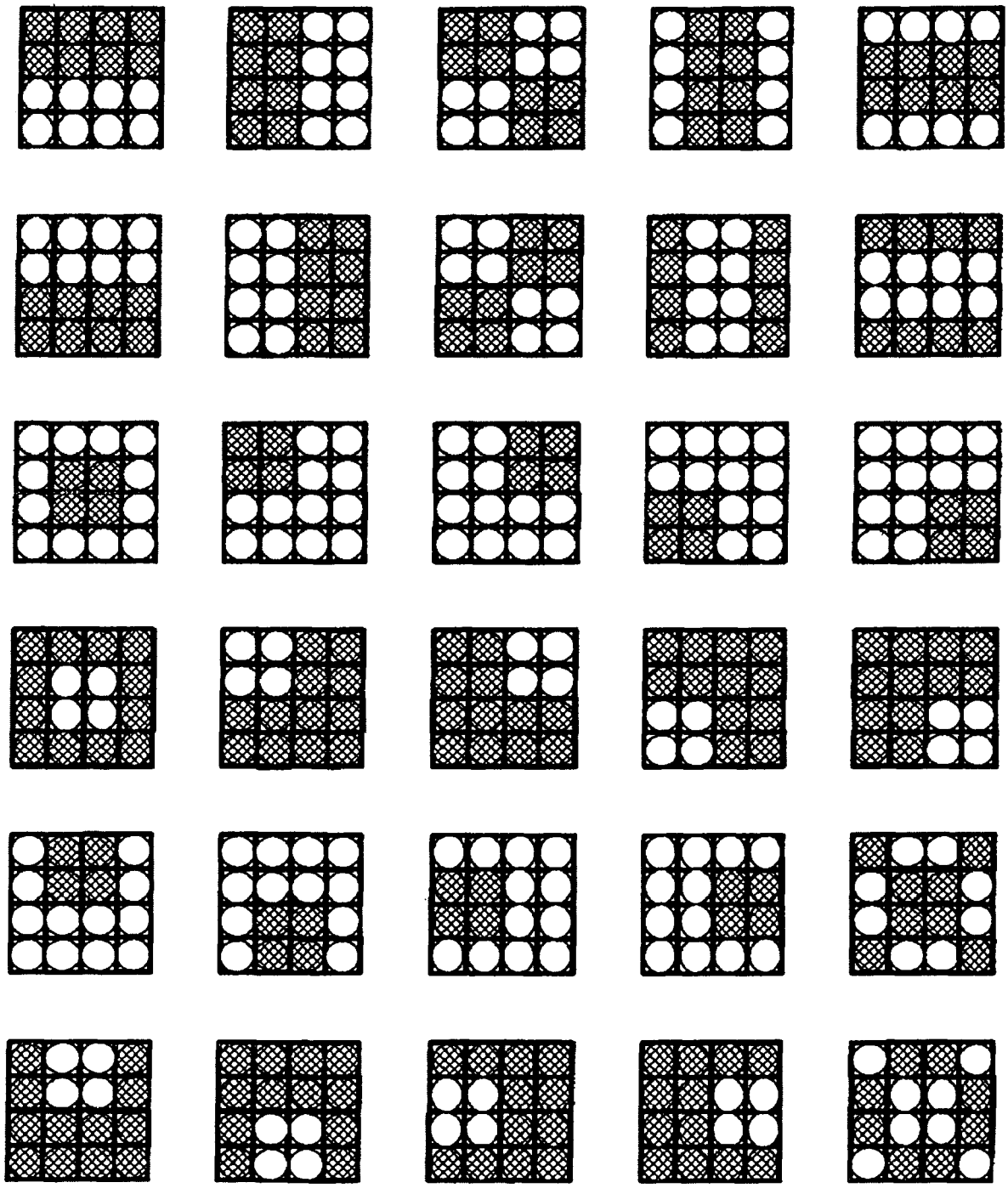
FIG. 3 is a view showing examples of a line segment pattern of a black-and-white image.

In this way, in black-and-white image display, it is possible to improve the resolution using the same four-color filters by performing display in units shifted by one sub-pixel (that is, half of a color pixel). FIG. 3 shows examples of a line segment pattern that can be displayed by two-by-two color pixels (that is, four by four sub-pixels) by the above-mentioned method.

When an input image is a black-and-white image, the image is generally configured by line segments such as characters or figures. Meanwhile, it is understood that the visual sensibility of a human being for a color image is high than that for a black-and-white image. Therefore, in the display device using a four-color filter according to an embodiment of the invention, when the input image is a black-and-white image, if line segments are detected from an input image signal and the line segments are displayed as black-and-white line segment patterns shown in FIG. 3, it is possible to improve the display resolution of a black-and-white image such as characters. Further, the detection of line segments is performed by matching the input image signals with the line segment patterns shown in FIG. 3, as will be described below.

Color Image Display

Next, color image display in the display device using a four-color filter will be described. When the input image is a color image and when the input image does not contain a line segment part even though the input image is a black-and-white image, the input image data is rendered to R, G, B, and C sub-pixels such that a color image is display (this is referred to as 'color-sub-pixel rendering'). FIGS. 4A to 4E show methods of rendering color-sub-pixel.

In FIGS. 4A to 4E, each circle corresponds to one sub-pixel. As the input image data, color data of twice as much as the number of pixels of the display panel in the horizontal direction and the vertical direction, respectively, as described above, that is, R, G, B, and C color data is input to every sub-pixel. Therefore, color data of one sub-pixel is calculated on the basis of color data of nine sub-pixels containing the one sub-pixel which have the same color.

Figure 4A:
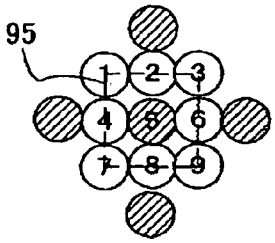
FIG. 4A is a view illustrating an example of a color sub-pixel rendering method.
Figure 4B:
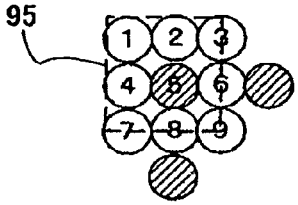
FIG. 4B is a view illustrating another example of the color sub-pixel rendering method.

In FIGS. 4A to 4B, sub-pixels marked with diagonal lines are subjected to rendering and the value of sub-pixel denoted by reference numeral '5' is calculated here. In particular, the output value of one color pixel shown by a dashed line 95 is calculated on the basis of the values of the sub-pixels denoted by reference numerals '1' to '9' containing the color pixel. Further, in FIGS. 4A to 4E, among R, G, B, and C color data, only R color data will be described but the same method can be applied to the other R, G, and B color data.

FIG. 4A shows the most typical example. Assuming that the pixel values of the sub-pixels denoted by reference numerals '1' to '9' are R1 to R9, respectively, the pixel value Rout of the color pixel shown by the dashed line 95 is calculated by Equation shown in FIG. 4A. In particular, the pixel values of each of the color pixels shown by the dashed line 95 is calculated by convoluting the pixel values of the sub-pixels in the region surrounded by the dashed line 95 using coefficients according to areas of the sub-pixels surrounded by the dashed line 95, respectively.

Figure 4C:
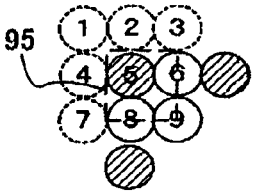
FIG. 4C is a view illustrating another example of the color sub-pixel rendering method.
Figure 4D:
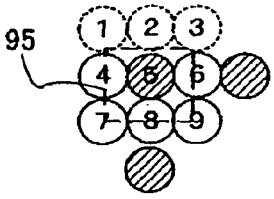
FIG. 4D is a view illustrating another example of the color sub-pixel rendering method.
Figure 4E:
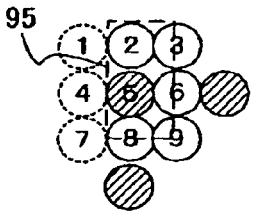
FIG. 4E is a view illustrating another example of the color sub-pixel rendering method.

FIG. 4B shows a case in which a color pixel shown by a dashed line 95 locates at the upper left corner of one of image data, and FIG. 4C shows a case in which the central sub-pixel contained in a color pixel shown by a dashed line 95 locates at the upper left corner of one of image data. Further, FIG. 4D shows a case in which a color pixel shown by a dashed line 95 locates at the upper edge of one of image data, and FIG. 4E shows a case in which a color pixel shown by a dashed line 95 locates at the left edge of one of image data.

In this way, the rendering of each sub-pixel of the four-color filter is performed using an input image signal containing R, G, B, and C color data in every sub-pixel of the four-color filter (that is, an input image data having twice the resolution of color pixels composed of four-color filters in the horizontal direction and the vertical direction), thereby color image display can be performed in the broad color reproduction area as shown in FIG. 1. Further, in each of the examples of FIG. 4A to 4E, the pixel value of the color pixel shown by dashed line 95 is calculated by convoluting the pixel values of the sub-pixels in the color pixel surrounded by the dashed line 95 using coefficients according to areas of the sub-pixels contained in the color pixel, respectively. However, the pixel value of the color pixel may be convoluted using coefficients according to distances from the central sub-pixel.

Image Display Device

Figure 5:
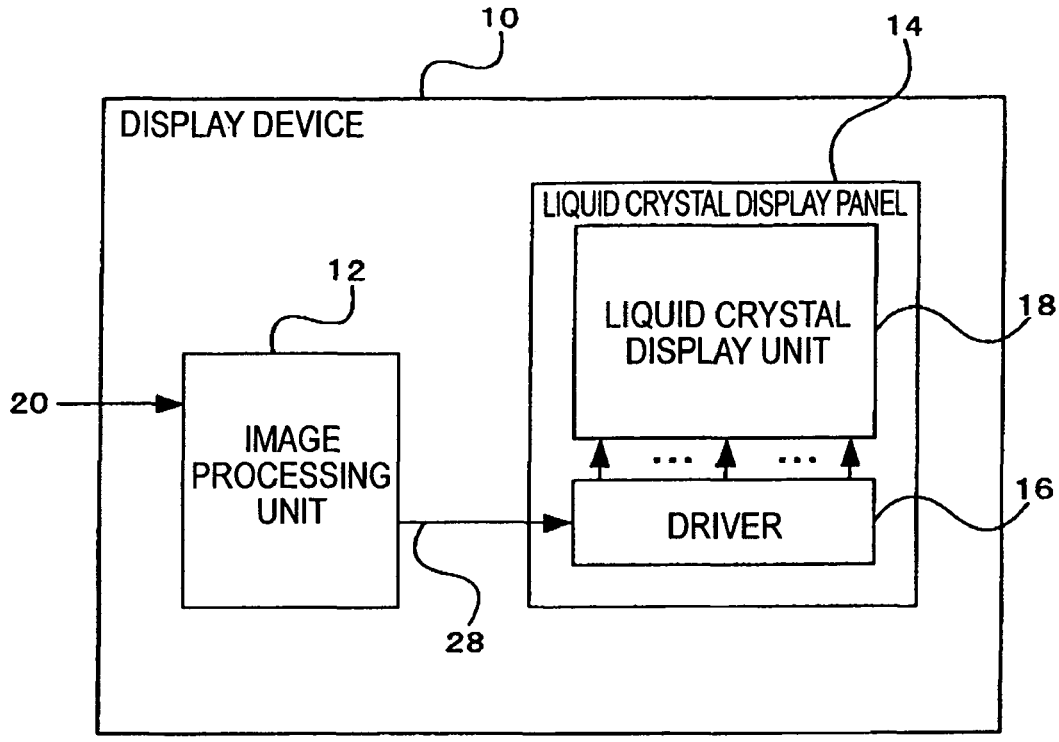
FIG. 5 is a block diagram schematically showing the construction of a display device according to an embodiment of the invention.

Next, an embodiment of a display device to which the above-mentioned color filter is applied will be described. FIG. 5 shows an example of the construction of a display device 10 according to the embodiment. The display device 10 can be applied to portable terminals such as a mobile phone, a PDA, etc. In FIG. 5, the display device 10 includes an image processing unit 12 and a liquid crystal display panel 14. The liquid crystal display panel 14 has a liquid crystal display unit 18 and a driver 16.

An RGB signal 20 is input from the outside to the display device 10. The RGB signal 20 includes an R signal Sr, a G signal Sg, and a B signal Sb. The image processing unit 12 generates four-color signals from the input RGB signal 20. The four-color signals correspond to R, G, B, and C, respectively, and are supplied to the driver 16 in the liquid crystal panel 14.

The liquid crystal display unit 18 is a liquid crystal display unit to which the above-mentioned four-color filter is applied. The driver 16 drives individual pixels of the liquid crystal display unit 18 on the basis of the input four-color signal 28. In this way, each pixel composed of a four-color filter is driven as shown in FIG. 2 and so on, and thus the image input as the RGB signal 20 is displayed in the liquid crystal display unit 18.

Next, the image processing unit 12 will be described in detail. The image processing unit 12 generates a four-color signal, which corresponds to each sub-pixel region of the four-color filter provided in the liquid crystal display unit 18, from the input RGB signal.

As has already been described, the four-color filter according to the embodiment of the invention has an advantage that the four-color filter has a broader color reproduction area for a color image signal than a general RGB color filter. Meanwhile, as has been described with reference to FIGS. 2 and 3, it is possible to display line segments contained in a black-and-white image with improved resolution than that of a color pixel.

Further, in this embodiment, it is discriminated whether the input image is a black-and-white (achromatic) image or a color (chromatic) image and then different processes are performed on the individual images. In particular, when the input image is a black-and-white image, line segments (vertical lines and horizontal lines) are detected from the input image and white or black is assigned to every pixel, thereby performing display that accentuates line segments (hereinafter, referred to as a 'lining process'). In this way, when the input image is a text or the like, it is possible to clearly display characters, figures, and so on.

Meanwhile, when the input image is a color image, the color image is displayed by the above-mentioned color sub-pixel rendering.

Figure 6:
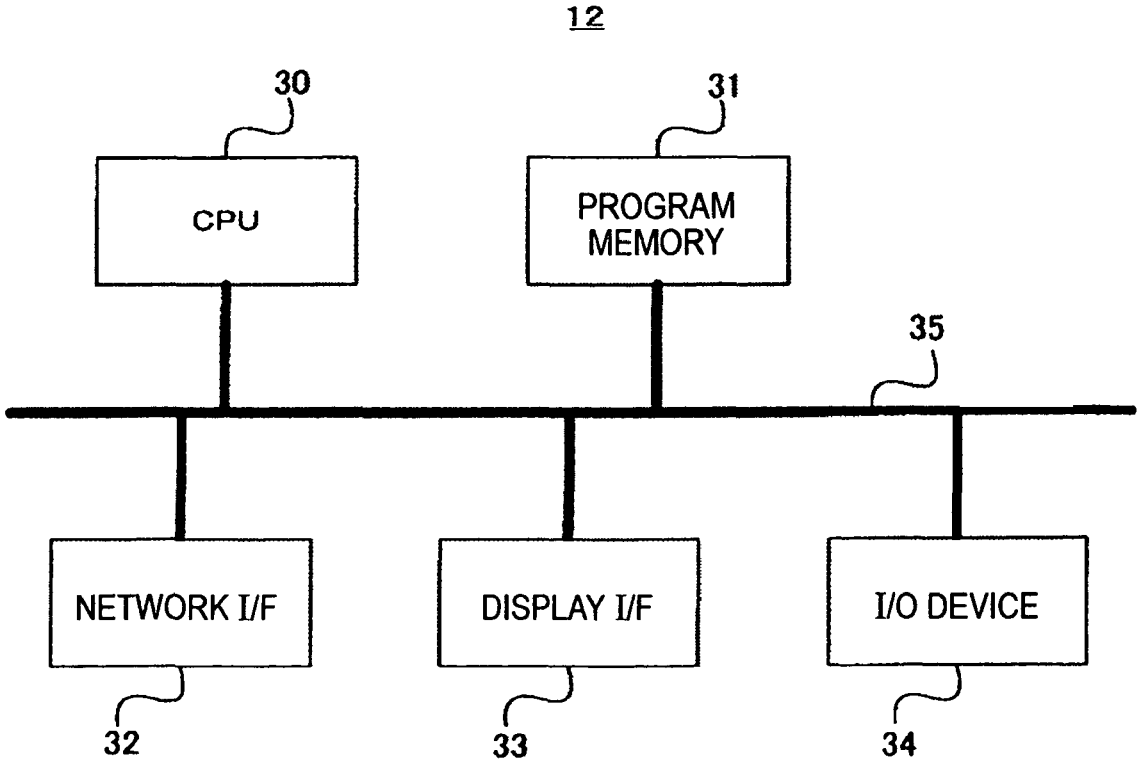
FIG. 6 is a block diagram schematically showing the construction of an image processing unit in accordance with an embodiment of the present invention.

FIG. 6 is a block diagram schematically showing the construction of the image processing unit 12 in a case of performing color conversion into the four-color filter by using software. The image processing unit 12 is configured such that a CPU 30, a program memory 31, a network I/F (interface) 32, a display I/F 33, an I/O (input/output) device 34 are connected to a bus 35. The program memory 31 stores a display process program to be described later. The network I/F 32 is used in a case of obtaining a source image such as an RGB signal or the like from a network, etc. The display I/F 33 is an interface for supplying four color signals 28 obtained by image processing to the liquid crystal display panel 14. The I/O device 34 is a device used for a user to do selection/instruction containing source image selection and so on. The CPU 30 not only controls the components of the image processing unit 12 but also performs display processing to be described later by executing a display process program stored in the program memory 31.

Figure 7:
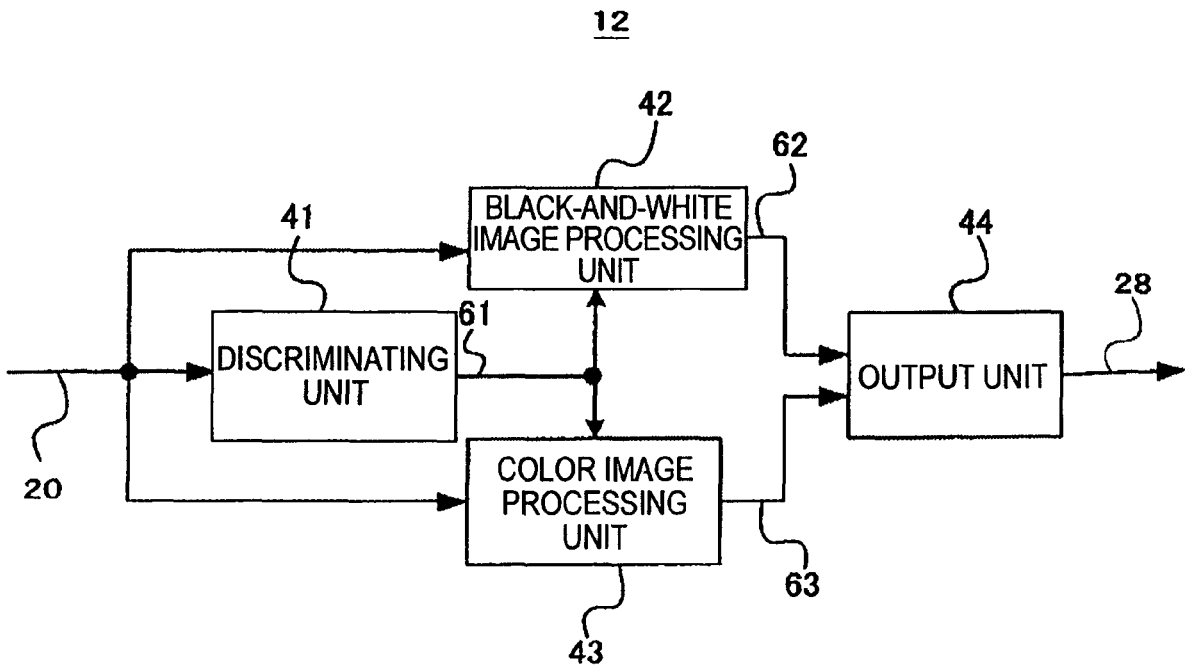
FIG. 7 is a block diagram illustrating the function of the image processing unit.

FIG. 7 is a block diagram illustrating the function of the image processing unit 12. The image processing unit 12 functionally has a discriminating unit 41, a black-and-white image processing unit 42, a color image processing unit 43, and an output unit 44. These components are implemented such that the CPU 30 executes a predetermined program, which is stored in the program memory 31.

The RGB signal 20 input to the image processing unit 12 is input to the discriminating unit 41, the black-and-white image processing unit 42, and the color image processing unit 43. The discriminating unit 41 converts the RGB signal 20 into a YUV signal and then generates a luminance signal Y and color difference signals U and V. Subsequently, the discriminating unit 41 discriminates whether the input RGB signal is a black-and-white image or a color image on the basis of the obtained color difference signals. In particular, the discriminating unit 41 discriminates whether the color difference signals U and V are less than a predetermined value X. When both signals are less than the predetermined value X, the discriminating unit 41 discriminates that the input image is a black-and-white image, and when at least one of both signals is not less than the predetermined value X, the discriminating unit 41 discriminates that the input image is a color image. As the predetermined value X, for example, a value around '0.1' (that is, 10%) can be used. In this case, the discriminating unit 41 discriminates that an image of which color component is less than 10% is a black-and-white image and an image of which color component is not less than 10% is a color image. A discrimination result signal 61 obtained in this way is sent to the black-and-white image processing unit 42 and the color image processing unit 43.

When the discrimination result signal 61 represents that the input image is a black-and-white image, the black-and-white image processing unit 42 operates to generate an image signal 62 by performing a lining process to be described on the input image so as to accentuate lines of the input image, and sends the generated image signal to the output unit (γ converter) 44 when the discrimination result signal 61 represents that the input image is a black-and-white image. Meanwhile, when the discrimination result signal 61 represents that the input image is a color image, the color image processing unit 43 operates to generate an image signal 63 by performing the color sub-pixel rendering process on the input image so as to improve the resolution, and sends the image signal 63 to the output unit 44. The output unit 44 performs γ conversion on the supplied image signal 62 or 63 on the basis of a predetermined γ characteristic to output the converted result as four color signals 28.

Figure 8:
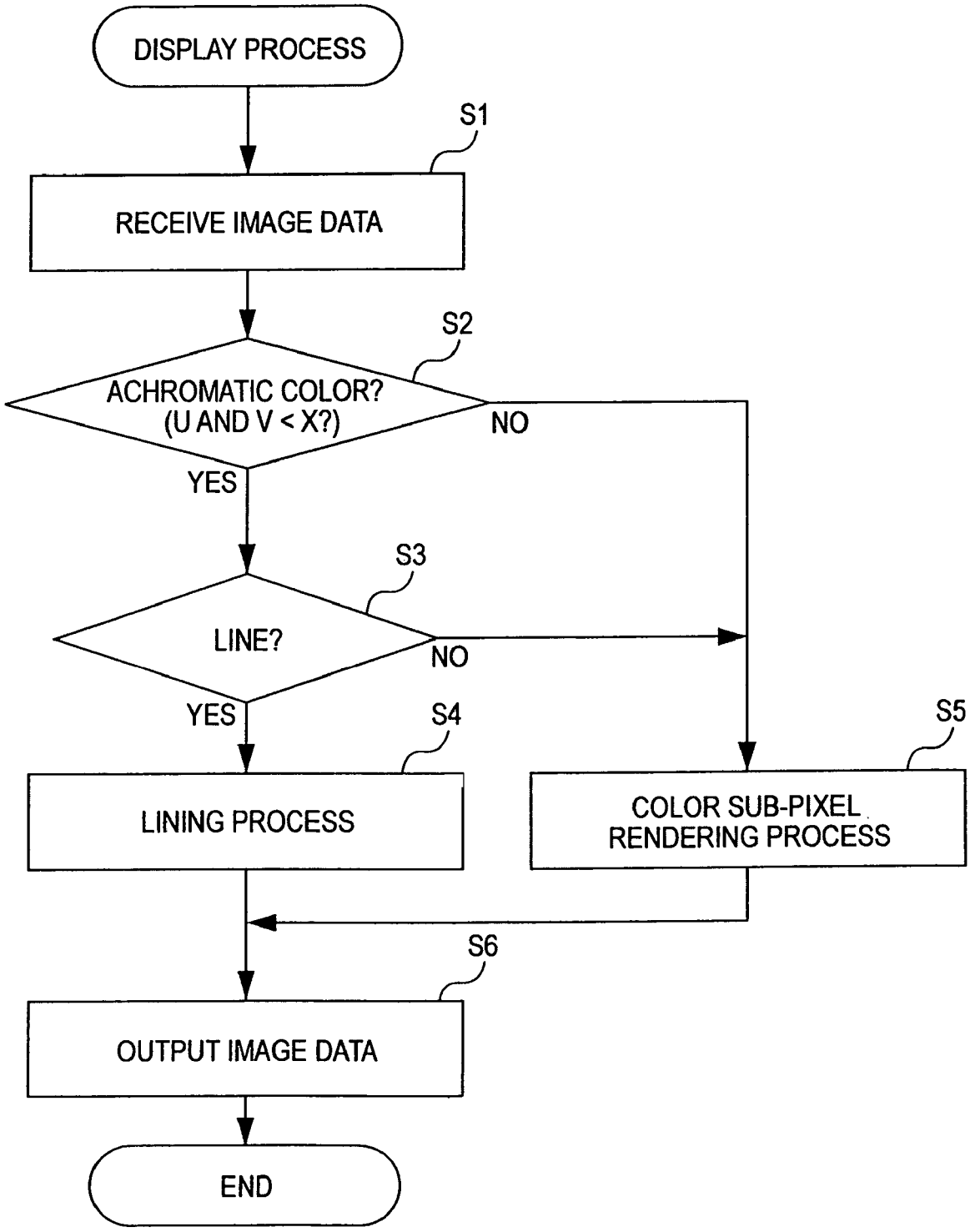
FIG. 8 is a flowchart illustrating a display process of the image processing unit.

FIG. 8 is a flowchart of display process performed by the image processing unit 12. When the CPU 30 executes the image display program so as to implement the function of the components shown in FIG. 7 as described above, the display process is performed. First, the discriminating unit 41 receives image data (that is, a RGB signal 20) from the outside (step S1). Next, the discriminating unit 41 generates color difference signals U and V by converting the image data into a YUV signal and discriminates whether the input image is a black-and-white (achromatic) image or a color (chromatic) image by comparing the color difference signals U and V to a predetermined value X (step S2).

Further, the discriminating unit 41 discriminates whether image data is a black-and-white image or a color image for every predetermined unit of image data. The predetermined unit of image data can be, for example, a two-by-two color pixels (that is, a four-by-four sub-pixels) shown in FIG. 2 or 3. The input image data has generally a resolution that is twice the resolution of color pixels in the horizontal direction and the vertical direction, respectively. In other words, the input image data has RGB color data for every sub-pixel. Therefore, the discriminating unit 41 performs YUV conversion on every sub-pixel of the predetermined unit of image data composed of the four-by-four (total sixteen) sub-pixels and discriminates whether each sub-pixel is a black-and-white sub-pixel or a color sub-pixel on the basis of the color difference signals U and V. When at least one of the sixteen sub-pixels is a color sub-pixel, the discriminating unit 41 discriminates that the predetermined unit of image data is a color image. When all the sixteen sub-pixels are black-and-white sub-pixels, the discriminating unit 41 discriminates that the predetermined unit of image data is a black-and-white image.

When it is discriminated that the input image is a black-and-white (Yes in step S2), the black-and-white image processing unit 42 detects lines. In order to detect lines, for the predetermined unit of image data (four-by-four sub-pixels in this embodiment), it is discriminated whether each sub-pixel is a black-and-white sub-pixel or a color sub-pixel by using a predetermined threshold. When it is discriminated that all the sixteen sub-pixels are white or black sub-pixels and the pattern matches any one of the line segment patterns shown in FIG. 3, it is discriminated that the predetermined unit of image data is a line segment part (Yes in step S3). Meanwhile, when the four-by-four sub-pixels includes a sub-pixel (that is, a gray pixel) other than white sub-pixels and black sub-pixels or when the pattern of white sub-pixels and black sub-pixels does not match any one of the line segment patterns shown in FIG. 3, it is discriminated that the predetermined unit of image data is not a line segment part (No in step S3).

When it is discriminated that the predetermined unit of image data is a line segment part (Yes in step S3), the black-and-white image processing unit 42 substitutes the predetermined unit of image data with the line segment pattern which matches the predetermined unit of image data. In other words, the black-and-white image processing unit 42 substitutes the color data of each sub-pixel of the predetermined unit of image data with the white sub-pixel value or the black sub-pixel value of the line segment pattern of FIG. 3 corresponding to the predetermined unit of image data. In this way, it is possible to improve the resolution of the line segment part. Subsequently, the black-and-white image processing unit 42 outputs the color data obtained by the substitution to the liquid crystal display panel 14 through the output unit 44 such that display is performed on the liquid crystal display panel 14 (step S6).

Meanwhile, when it is discriminated that the input image is a color image (No in step S2) or when it is discriminated that the predetermined unit of image data is not a line segment part even though it is discriminated that the input image is a black-and-white image (No in step S3), the color image processing unit 43 generates color image data by performing the color sub-pixel rendering process described above with reference to FIG. 4 and supplies the generated color image data to the liquid crystal display panel 14 (step S6). At the time of performing the color sub-pixel rendering process, the color image processing unit 43 coverts the YUV image data obtained in step S2 into RGBC image data. This converting process can be performed, for example, by using a three-dimensional look-up table (LUT) defining the correspondence relation between YUV values and RGBC values, etc.

As described above, in the display device having four-color filters according to the disclosed embodiment of the invention, when the input image is a black-and-white image and has line segments, four-color data is defined by a lining process so as to accentuate the line segments. Therefore, it is possible to improve the resolution of the black-and-white image. Meanwhile, when the input image is a color image and when the input image is a black-and-white image but the input image doesn't have any line segment, four-color data is generated by the color sub-pixel rendering process. Therefore, it is possible to perform color image display with excellent color reproductivity.

A further embodiment, while being similar to the previously disclosed embodiment, has a resolution that is improved in the horizontal or vertical direction by devising arrangement of sub-pixels in four-color filters.

Figure 9A:
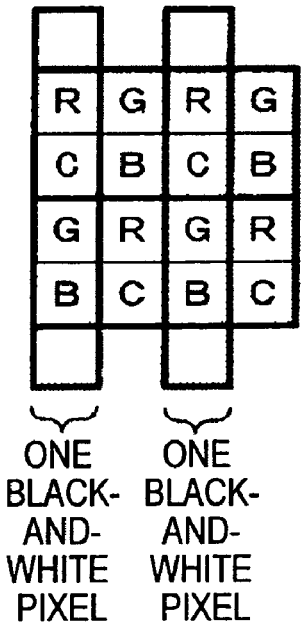
FIG. 9A is a view showing an example of the arrangement of color filters according to a further embodiment of the invention.
Figure 9B:
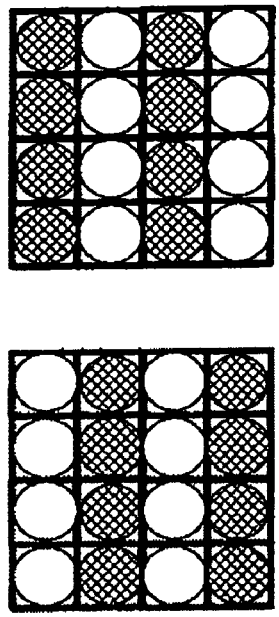
FIG. 9B is a view showing an example of line segment pattern that can be represented by the color filters according to a further embodiment of the invention.

FIG. 9A shows an example of the arrangement of sub-pixels of four-color filter with improved resolution in the horizontal direction. In the example of FIG. 9A, four sub-pixels arranged in the vertical direction can constitute one black-and-white pixel. Therefore, line segment patterns shown in FIG. 9B also can be used, thereby it is possible to further improve the resolution of a black-and-white image in the horizontal direction.

Figure 9C:
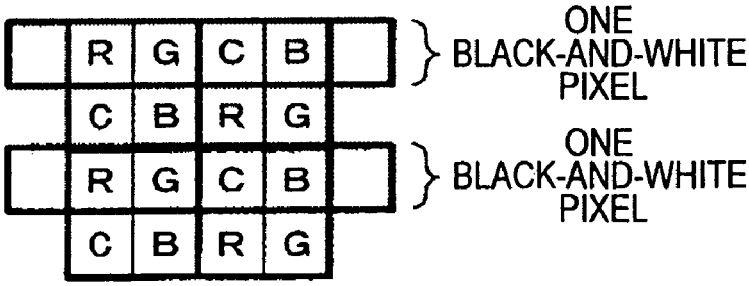
FIG. 9C is a view showing another example of the arrangement of the color filters according to a further embodiment of the invention.
Figure 9D:
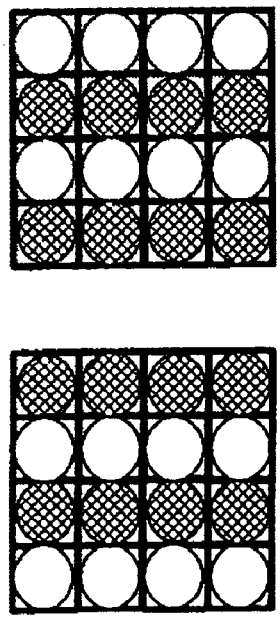
FIG. 9D is a view showing another example of the line segment pattern that can be represented by the color filters according to a further embodiment of the invention.

FIG. 9C shows another example of the arrangement of sub-pixels of four-color filter with improved resolution in the vertical direction. In the example of FIG. 9C, four sub-pixels arranged in the horizontal direction can constitute one black-and-white pixel. Therefore, line segment patterns shown in FIG. 9D also are used, thereby it is possible to further improve the resolution of a black-and-white image in the vertical direction.

Liquid Crystal Display Panel

Figure 10:
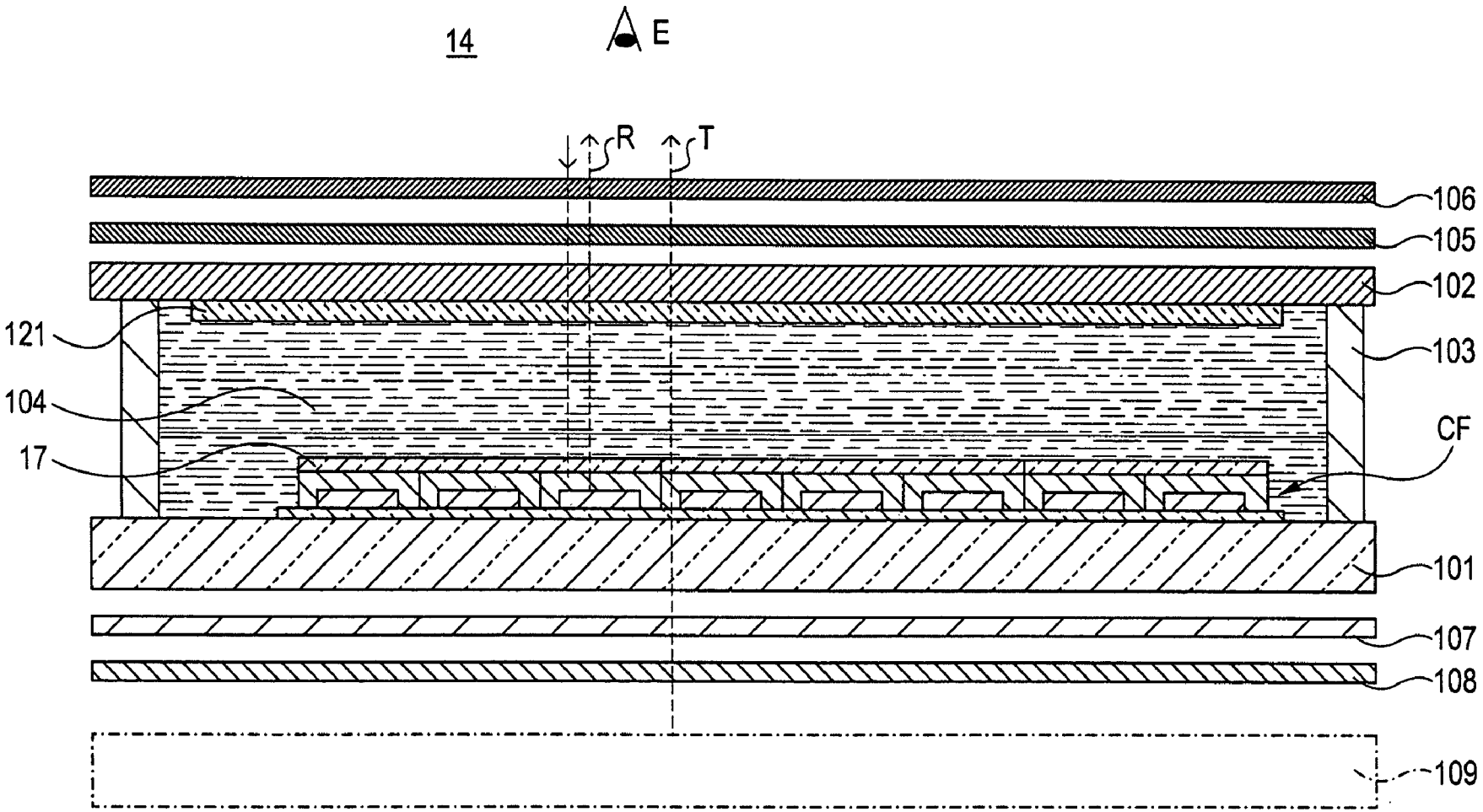
FIG. 10 is a view showing the construction of a liquid crystal display panel according to an embodiment of the invention

Next, an example of a liquid crystal display panel to which a color filter substrate according to an embodiment of the invention is applied will be described. According to this example, a color filter substrate having the above-mentioned four-color filters is applied to a transflective liquid crystal display panel 14. FIG. 10 is a cross-sectional view of the liquid crystal display unit 18.

In FIG. 10, the liquid crystal display panel 14 includes two substrates 101 and 102 that are made of glass, plastic, or the like and are bonded to each other by means of a sealant 103, and liquid crystal 104 interposed between the substrates 101 and 102. Further, a retardation film 105 and a polarizing plate 106 are subsequently disposed on the external surface of the substrate 102, and a retardation film 107 and a polarizing plate 108 are subsequently disposed on the external surface of the substrate 101. Furthermore, a backlight 109 which emits illuminating light at the time of performing transmissive display is disposed below the polarizing plate 108.

The substrate 101 is a transparent substrate made of glass or the like and the above-mentioned four-color filters CF are formed on the substrate 101. In particular, R, G, B, and C filter regions are arranged as described above. Further, if necessary, a transparent resin scattering layer may be formed of an acryl resin or the like on the substrate 101. Furthermore, metal films may be formed in reflective regions on the resin scattering layer. In addition, in the reflective regions, color filters may be formed on the metal films, respectively.

Furthermore, if necessary, a black matrix may be formed at borders among the individual color filters. On the color filters CF, transparent electrodes 17 are formed of a transparent conductive material such as ITO (indium tin oxide). According to the present embodiment, the transparent electrodes 17 are formed in stripes to be parallel to each other. Also, the transparent electrodes 17 extend in the direction orthogonal to transparent electrodes 121 which are formed on the substrate 102 in stripes. The members that constitute the liquid crystal display panel 14 and are included at intersections between the transparent electrodes 17 and the transparent electrodes 121 constitute pixel regions 20.

On the other hand, transparent electrodes 121 are formed on the internal surface of the substrate 102 so as to intersect the transparent electrodes 17 on the substrate 101 opposite to the substrate 102. Further, if necessary, alignment films may be formed on the transparent electrodes 17 on the substrate 101 and on the transparent electrodes 121 on the substrate 102.

In the liquid crystal display panel 14, when the reflective display is performed, external light incident onto the region where the metal reflecting films are formed is directed along the path R illustrated in FIG. 10 and is reflected by the metal reflecting films so that an observer can view the external light. On the other hand, when the transmissive display is performed, the illuminating light emitted from the backlight 109 is incident onto the transmissive region and travels along the path T so that an observer can view the illuminating light.

The above-mentioned liquid crystal display panel is just an example in which the four-color filter according to the disclosed embodiments of the invention is applied, and the four-color filter can be applied to various liquid crystal display panels having other constructions.

Electronic Apparatus

Next, an example of an electronic apparatus to which the liquid crystal display panel according to the disclosed embodiments of the invention can be applied will be described with reference to FIGS. 11A and 11B.

First, an example in which the liquid crystal display panel according to an embodiment of the invention is applied to a display unit of a portable personal computer (a so-called notebook personal computer) will be described. FIG. 11A is a perspective view showing the construction of the personal computer. As shown in FIG. 11B, a personal computer 410 includes a main body 412 having a keyboard 411 and a display unit 413 to which the liquid crystal display panel according to an embodiment of the invention is applied.

Subsequently, an example in which the liquid crystal display panel according to an embodiment of the invention is applied to a display unit of a mobile phone will be described. FIG. 11B is a perspective view showing the construction of the mobile phone. As illustrated in FIG. 11B, a mobile phone 420 includes a plurality of operating buttons 421, an earpiece 422, a mouthpiece 423, and a display unit 424 to which the liquid crystal display panel according to an embodiment of the invention is applied.

Figure 11A:
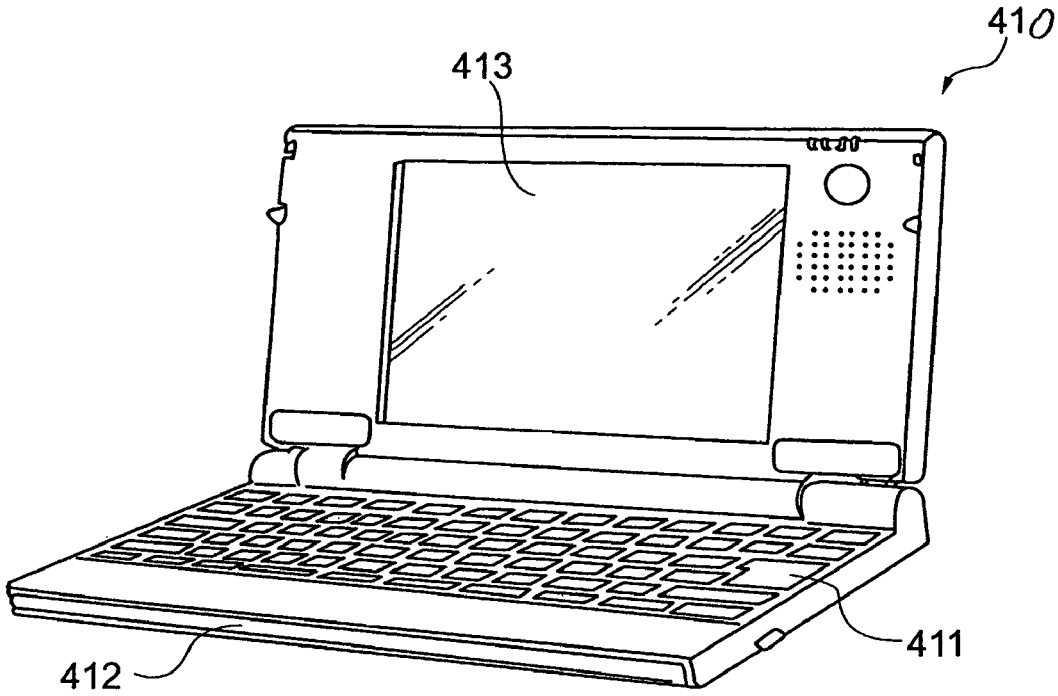
FIG. 11A is a view showing an example of an electronic apparatus according to an embodiment of the invention.
Figure 11B:
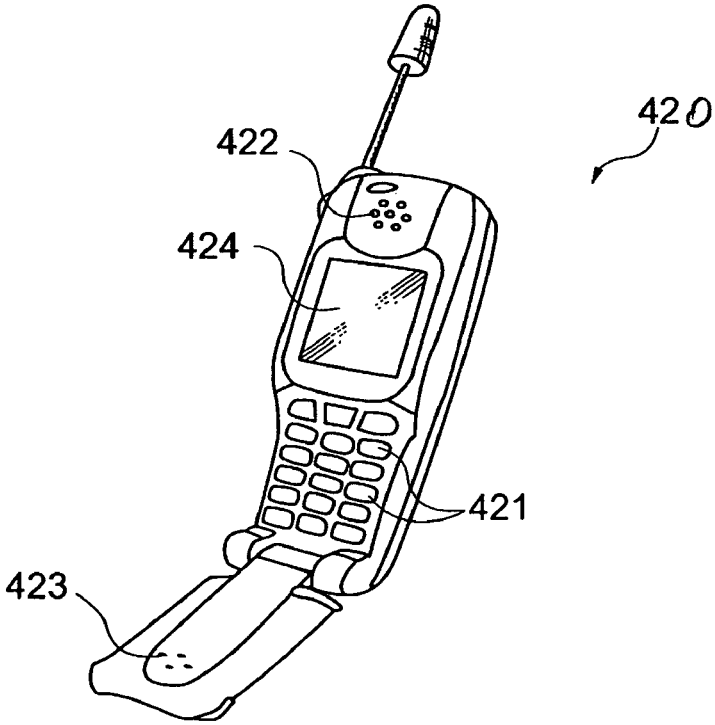
FIG. 11B is a view showing another example of the electronic apparatus according to a further embodiment of the invention.

In addition, the electronic apparatuses to which the liquid crystal display panels according to an embodiment of the invention can be applied include a liquid crystal TV, a view finder type and monitor direct-view-type videotape recorder, a car navigator, a pager, an electronic organizer, a calculator, a word processor, a work station, a video phone, a POS terminal, and a digital still camera, as well as the personal computer shown in FIG. 11A and the mobile telephone shown in FIG. 11B.

The embodiments of the invention advantageously provide an image display device in which four color sub-pixel regions form one pixel which can display color images with high color reproductivity and high-definition black-and-white images, by using a color input image signal such as a RGB signal.

MODIFICATIONS

The substrate and the liquid crystal device having the above-mentioned reflective layer and color filters are not limited to the above-mentioned embodiments but various changes may be made without departing from the spirit and scope of the invention.

According to the above-mentioned embodiments, the liquid crystal display panel is described as an example. However, the electro-optical device according to embodiments of the invention can also be applied to an electrophoresis device such as an electronic paper and an electroluminescent (EL) device.

What is claimed is:

1. An image display device, comprising:

a processor;

a display panel operatively connected to the processor, the display panel having a plurality of pixels, wherein each of said pixels has a plurality of color sub-pixels; and a memory device storing instructions which when executed by the processor, cause the processor, in cooperation with the display panel, to:

(a) receive image data;

(b) determine whether the received image data includes:

(i) black-and-white image data; or (ii) color image data;

(c) in response to the received image data being black-and-white image data:

(i) determine whether received image data matches at least one of a plurality of predetermined line segment patterns which each have separate values;

(ii) in response to the received image data matching the at least one predetermined line segment pattern, for a black-and-white image corresponding to the matched line segment pattern:

(A) substitute the received image data with the values of the matched line segment pattern;

wherein the instructions, when executed by the processor, cause the processor to:

(1) determine whether each sub-pixel in each data unit of the received image data is a white sub-pixel or a black sub-pixel based on luminance values of the sub-pixels in said data unit;

(2) compare the pattern of the white and the black sub-pixels contained in said data unit with the predetermined line segment patterns; and (3) in response to the pattern of the white and the black sub-pixels matching one of the predetermined line segment patterns, generate color signals for a black-and-white image corresponding to the matched line segment pattern; and (B) cause the display panel to display data based on the substituted values of the matched line segment pattern;

(iii) in response to the received image data not matching any of the plurality of predetermined line segment patterns, for a first color image:

(A) generate first color signals; and (B) cause the display panel to display data based on the generated first color signals;

(d) in response to said received image data being color image data for a second color image:

(i) generate second color signals; and (ii) cause the display panel to display data based on the generated second color signals.

2. The image display device of claim 1, wherein:

(a) the plurality of color sub-pixels in each of said pixels are arranged in a vertical direction so as to form said pixel as a vertical pixel; and (b) the instructions, when executed by the processor, cause the processor to generate signals for a black-and-white image representing white or black in one pixel unit in the vertical direction.

3. The image display device of claim 1, wherein:

(a) the plurality of color sub-pixels in each of said pixels are arranged in a horizontal direction so as to form said pixel as a horizontal pixel; and (b) the instructions, when executed by the processor, cause the processor generate signals for a black-and-white image representing white or black in one pixel unit in the horizontal direction.

4. The image display device of claim 1, wherein the instructions, when executed by the processor, cause the processor to:

(a) convert the received image data into a luminance signal and a color difference signal;

(b) determine that the image data is black-and-white image data when the color difference signal is less than a predetermined value; and (c) determine that the image data is color image data when the color difference signal is not less than the predetermined value.

5. The image display device of claim 1, wherein:

(a) the input image signal has a number of pixels which is twice the number of pixels of the display unit; and (b) the instructions, when executed by the processor, cause the processor to generate a color value for each sub-pixel based on color values of a plurality of sub-pixels that have the same color as said sub-pixel and are adjacent to said sub-pixel.

6. An electronic apparatus, comprising:

the image display device of claim 1.

7. The image display device of claim 1, wherein each said data unit comprises image data corresponding to more than one pixel of the display panel.

8. The image display device according to of claim 1, wherein:

(a) the received image data includes, for each sub-pixel of the display panel, image data of more than one color; and (b) the instructions, when executed by the processor, cause the processor to:

(i) determine whether the image data of more than one color inputted for each said sub-pixel represents a black sub-pixel or a white sub-pixel or a color sub-pixel of a color other than black and white;

(ii) determine that the data unit is color image data if at least one of the sub-pixels of the data unit is a color sub-pixel; and (iii) determine that the data unit is black-and-white image data if every sub-pixel of the data unit is a black sub-pixel or a white sub-pixel.

9. The image display device of claim 1, wherein:

(a) each pixel includes four sub-pixels; and (b) the instructions, when executed by the processor, cause the processor to generate the black-and-white image data by combining (i) two sub-pixels of said one of the pixels and (ii) two sub-pixels of the adjacent pixel into the new pixel.

10. An image processing unit, comprising:

a processor; and a memory device storing instructions which when executed by the processor, cause the processor, in cooperation with the display panel, to:

(a) receive image data;

(b) determine whether the received image data includes:

(i) black-and-white image data; or (ii) color image data;

(c) in response to the received image data being black-and-white image data:

(i) determine whether received image data matches at least one of a plurality of predetermined line segment patterns which each have separate values:

(ii) in response to the received image data matching the at least one predetermined line segment pattern, for a black-and-white image corresponding to the matched line segment pattern:

(A) substitute the received image data with the values of the matched line segment pattern;

wherein the instructions, when executed by the processor, cause the processor to:

(1) determine whether each sub-pixel in each data unit of the received image data is a white sub-pixel or a black sub-pixel based on luminance values of the sub-pixels in said data unit; and (2) compare the pattern of the white and the black sub-pixels contained in said data unit with the predetermined stored line segment patterns; and (3) in response to the pattern of the white and the black sub-pixels matching one of the predetermined line segment patterns, generate color signals for a black-and-white image corresponding to the matched line segment pattern; and (B) cause the display panel to display data based on the substituted values of the matched line segment pattern;

(iii) in response to the received image data not matching any of the plurality of predetermined line segment patterns, for a first color image:

(A) generate first color signals; and (B) cause the display panel to display data based on the generated first color signals;

(d) in response to said received image data being color image data, for a second color image:

(i) generate second color signals; and (ii) cause the display panel to display data based on the generated second color signals.

11. The image processing unit of claim 10, wherein the instructions, when executed by the processor, cause the processor to:

(a) convert the received image data into a luminance signal and a color difference signal;

(b) determine that the image data is black-and-white image data when the color difference signal is less than a predetermined value; and (c) determine that the image data is color image data when the color difference signal is not less than a predetermined value.

12. The image processing unit of claim 10, wherein the instructions, when executed by the processor, cause the processor to generate a color value for each sub-pixel based on color values of a plurality of sub-pixels that have the same color as said sub-pixel and are adjacent to said sub-pixel.

13. The image processing unit of claim 10, wherein the instructions, when executed by the processor, cause the processor to:

(a) determine whether each sub-pixel in each data unit of the input image signal is a white sub-pixel or a black sub-pixel;

(b) compare a pattern of white and black sub-pixels contained in said data unit with the predetermined line segment patterns; and (c) in response to the pattern of white and black sub-pixels in said data unit matching one of the predetermined line segment patterns, substitute color data of each sub-pixel of the data unit with the corresponding white or black sub-pixel value of the matched predetermined line segment pattern.

14. A method of operating an image processing unit, the method comprising:

causing a processor of the image processing unit to execute instructions to cause the image processing unit to:

(a) receive image data;

(b) determine whether the received image data includes:

(i) black-and-white image data; or (ii) color image data;

(c) in response to the received image data being black-and-white image data:

(i) determine whether received image data matches at least one of a plurality of predetermined line segment patterns which each have separate values;

(ii) in response to the received image data matching the at least one predetermined line segment pattern, for a black-and-white image corresponding to the matched line segment pattern:

(A) substitute the received image data with the values of the matched line segment pattern;

which includes causing the processor of the image processing unit to execute the instructions to cause the image processing unit to:

(1) determine whether each sub-pixel in each data unit of the received image is a white sub-pixel or a black sub-pixel based on luminance values of the sub-pixels in said data unit;

(2) compare the pattern of the white and the black sub-pixels contained in said data unit with the predetermined line segment patterns; and (3) in response to the pattern of the white and the black sub-pixels matching one of the predetermined line segment patterns, generate color signals for a black-and-white image corresponding to the matched line segment pattern; and (B) cause the display panel to display data based on the substituted values of the matched line segment pattern;

(iii) in response to the received image data not matching any of the plurality of predetermined line segment patterns, for a first color image:

(A) generate first color signals; and (B) cause the display panel to display data based on the generated first color signals;

(d) in response to said received image data being color image data, for a second color image:

(i) generate second color signals; and (ii) cause the display panel to display data based on the generated second color signals.

15. The method of claim 14, which includes causing the processor of the image processing unit to execute the instructions to cause the image processing unit to:

(a) convert the received image data into a luminance signal and a color difference signal;

(b) determine that the image data is black-and-white image data when the color difference signal is less than a predetermined value; and (c) determine that the image data is color image data when the color difference signal is not less than the predetermined value.

16. The method of claim 14, which includes causing the processor of the image processing unit to execute the instructions to cause the image processing unit to generate a color value for each sub-pixel on the basis of color values of a plurality of sub-pixels that have the same color as said sub-pixel and are adjacent to said sub-pixel.

17. The method of claim 14, wherein each of the predetermined line segment patterns includes a plurality of adjacent sub-pixels each being either a white sub-pixel or a black sub-pixel.

* * * * *